US008714858B2

(12) United States Patent
Screnci, Jr. et al.

(10) Patent No.: US 8,714,858 B2
(45) Date of Patent: May 6, 2014

(54) SELF-FOAMING SHAVING BRUSH

(75) Inventors: Ralph Screnci, Jr., Fort Lauderdale, FL (US); Ozgur Alci, Fort Lauderdale, FL (US)

(73) Assignee: Old Skool Productions, LLC, Fort Lauderdale, FL (US)

( * ) Notice: Subject to any disclaimer, the term of this patent is extended or adjusted under 35 U.S.C. 154(b) by 417 days.

(21) Appl. No.: 13/072,913

(22) Filed: Mar. 28, 2011

(65) Prior Publication Data

US 2012/0246856 A1 Oct. 4, 2012

(51) Int. Cl.
*A46B 11/04* (2006.01)
*A45D 27/02* (2006.01)
*A45D 27/04* (2006.01)

(52) U.S. Cl.
CPC ..... *A45D 27/02* (2013.01); *A45D 27/04* (2013.01); *A46B 2200/1033* (2013.01)
USPC ..... 401/282; 401/286

(58) Field of Classification Search
USPC ..... 401/268–291; 15/160; 132/200
See application file for complete search history.

(56) References Cited

U.S. PATENT DOCUMENTS

| | | | | | |
|---|---|---|---|---|---|
| 1,950,155 | A | * | 3/1934 | Statham | 401/286 |
| 3,173,167 | A | * | 3/1965 | Kaufman | 401/190 |
| 3,228,057 | A | * | 1/1966 | Parrish | 401/133 |
| 3,231,923 | A | * | 2/1966 | Gaines | 401/190 |
| 3,256,549 | A | * | 6/1966 | Evesque | 401/190 |
| 3,388,958 | A | | 6/1968 | Modla | |
| 3,408,151 | A | * | 10/1968 | Cleghorn | 401/291 |
| 3,653,090 | A | | 4/1972 | Weaver | |
| 3,981,597 | A | * | 9/1976 | Cohn | 401/190 |
| 4,252,455 | A | | 2/1981 | de la Pena | |
| 4,533,273 | A | * | 8/1985 | Obata et al. | 401/190 |
| 4,603,992 | A | | 8/1986 | Kavoussi | |
| 4,636,102 | A | * | 1/1987 | Drake | 401/190 |
| 4,848,946 | A | * | 7/1989 | Goncalves | 401/131 |
| 6,003,523 | A | | 12/1999 | Nettlefold | |
| 2013/0118515 | A1 | * | 5/2013 | Wurtz et al. | 132/200 |

FOREIGN PATENT DOCUMENTS

EP 0126905 A2 12/1984

* cited by examiner

*Primary Examiner* — David Walczak
*Assistant Examiner* — Jennifer C Chiang
(74) *Attorney, Agent, or Firm* — The Concept Law Group, P.A.; Scott D. Smiley; Mark C. Johnson

(57) ABSTRACT

A shaving brush assembly includes a plurality of bristles, a base with a first side coupled to and supporting the plurality of bristles, a second side opposite the first side, and defining a passageway from the first side to the second side, the passageway dimensioned to receive at least a portion of a nozzle of a shaving cream container. The assembly also includes a sleeve coupled to and extending from the second side of the base, with the sleeve having an inner diameter less than an outer diameter of a standard-sized container of shaving cream.

15 Claims, 5 Drawing Sheets

200

100

SELF-FOAMING SHAVING BRUSH

FIELD OF THE INVENTION

The present invention relates generally to shaving brushes, and more particularly relates to shaving brushes receiving controlled amounts of shaving cream from an attached container of shaving cream.

BACKGROUND OF THE INVENTION

"Shave brush" or "shaving brush" are terms used to describe a small brush, such as that shown in FIG. 1, with a handle 102 coupled to the base of a set of bristles 104. The shaving brush's bristles 104 are used to transfer shaving cream to a user's face or other body parts just prior to the use of a razor.

Typically, a user grasps the handle 102 and uses it to dip the bristles 104 into an amount of shaving cream and then applies it to the face or other area to be shaved. Alternatively, the user vigorously works the bristles 104 into an amount of soap and then applies the resulting foam to the face or other area to be shaved. Advantageously, the handle 102 allows the user to apply the shaving cream without it making contact with the user's hand. Unfortunately, the process of using a shaving brush is somewhat messy as the user must dispense an amount of shaving cream into a container of sufficient size for the user to be able to dip the brush bristles 104 into the cream. After shaving, the container must then be cleaned to remove the shaving cream or foaming soap.

Some entities have attempted to alleviate the steps of first, dispensing the shaving cream into the container and second, having to clean the container. Two such proposed solutions are described in U.S. Pat. Nos. 3,653,090 and 6,003,523, which both provide a shaving brush with a vertical bore that extends centrally through the body of the brush handle, The vertical bore forms a passageway for the delivery of shaving cream through the brush structure and receives the shaving cream from the valve orifice of a standard-sized pressurized shaving cream container. "Standard-sized," as used herein, indicates a container, e.g., a can, having an outer diameter of about 2.75" or more and a length of about 6". By bringing the handle in contact with the container, the container's valve is actuated and shaving cream is delivered through the passageway and into the bristles. However, the devices described in U.S. Pat. Nos. 3,653,090 and 6,003,523 suffer from the disadvantage of having to be placed in contact with the standard-sized pressurized shaving-cream container each time shaving cream is required at the brush. This contact may be necessary two or more times during a single shave. In addition, because the backside, i.e., the side opposite the bristles, is exposed to air, shaving cream within the passageway has a tendency to dry within and block the passageway from further delivery of shaving cream. For this reason, the device in U.S. Pat. No. 3,653,090 requires a separate stand with a stem that must be inserted within the passageway and stored in conjunction with the shaving brush. The stand presents an extra costly part to manufacture and ship and is an extra. object for the user to keep track of.

Examples of other devices that have attempted to correct the problems shared by the two-part solutions taught by U.S. Pat. Nos. 3,653,090 and 6,003,523 are described in U.S. Pat. Nos. 3,388,958, 4,252,455, and 4,603,992. Each of these devices couples a shaving brush to the upper portion of a standard-sized pressurized shaving-cream container, By coupling the brush to the shaving-cream container, each of these solutions eliminates the disadvantages described in the preceding paragraph, where the brush needs to be repeatedly placed in contact with the container. However, each of these solutions also disadvantageously results in a brush with a large container affixed to the brush. This large and relatively heavy container must be manipulated as the user is applying shaving cream to their face or other body part. Moving the large can and brush feels very bulky and unnatural. In addition, because the brush is affixed to the upper portion of the full-size shaving-cream container, the device is rather tall and is not easy to store in a typical medicine cabinet or drawer.

Therefore, a need exists to overcome the problems with the prior art as discussed above.

SUMMARY OF THE INVENTION

The invention provides a self-foaming shaving brush that overcomes the hereinafore-mentioned disadvantages of the heretofore-known devices and methods of this general type and that provides continuous shaving cream at the distal end of the brush portion.

With the foregoing and other objects in view, there is provided, in accordance with the invention, a shaving brush assembly that includes a plurality of bristles, a base with a first side coupled to and supporting the plurality of bristles, a second side opposite the first side, and defining a passageway from the first side to the second side, the passageway dimensioned to receive at least a portion of a nozzle of a shaving cream container. The assembly also includes a sleeve coupled to and extending from the second side of the base, with the sleeve having an inner diameter less than an outer diameter of a standard-sized container of shaving cream.

In accordance with a further feature of the present invention, the inner diameter of the sleeve is greater than a largest outer diameter of a travel-size container shaving cream.

In accordance with an additional feature of the present invention, the passageway includes an inner diameter that is greater than a largest outer diameter of a dispensing nozzle of a container of shaving cream.

In accordance with another feature of the present invention, the passageway includes a first inner diameter that is less than a largest outer diameter of a dispensing nozzle of a container of shaving cream and a second inner diameter that is greater than a largest outer diameter of a dispensing nozzle of a container of shaving cream.

In accordance with yet another feature of the present invention, the first inner diameter of the passageway is closer to the first side of the base than is the second inner diameter.

In accordance with a further feature of the present invention, a length of the sleeve is substantially the standard length of a travel-size container of shaving cream.

In accordance with the present invention, a method for applying shaving cream to a shaving brush includes the step of providing a shaving brush assembly that includes a plurality of bristles, a base that has a first side coupled to and supporting the plurality of bristles, a second side opposite the first side, and a passageway defined from the first side to the second side, and a sleeve coupled to the base, the sleeve having an inner diameter less than an outer diameter of a standard-sized container of shaving cream. The method further includes the steps of inserting a travel-size container of shaving cream within the sleeve so that a dispensing nozzle of the travel-size container of shaving cream is inserted at least partially within the passageway and applying a pressing force to the travel-size container of shaving cream in a direction toward the bristles.

In accordance with the present invention, a method of manufacturing a shaving brush assembly includes the step of providing a shaving brush assembly that includes a plurality of bristles, a base that has a first side coupled to and supporting the plurality of bristles, and a second side opposite the first side. The method further includes the steps of boring a passageway from the first side of the base to the second side of the base, the passageway dimensioned to receive at least a portion of a nozzle of a shaving cream container and coupling a sleeve to the base, the sleeve extending from the second side of the base and having an inner diameter less than an outer diameter of a standard-sized container of shaving cream.

Although the invention is illustrated and described herein as embodied in a self-foaming shaving brush, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure, In this document, the term "longitudinal" should be understood to mean in a direction corresponding to an elongated direction of the handle and/or bristles.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

HG. 7 is flow diagram illustrating a process of using a self-foaming shaving brush assembly in accordance with the present invention.

DETAILED DESCRIPTION

Figure 2:
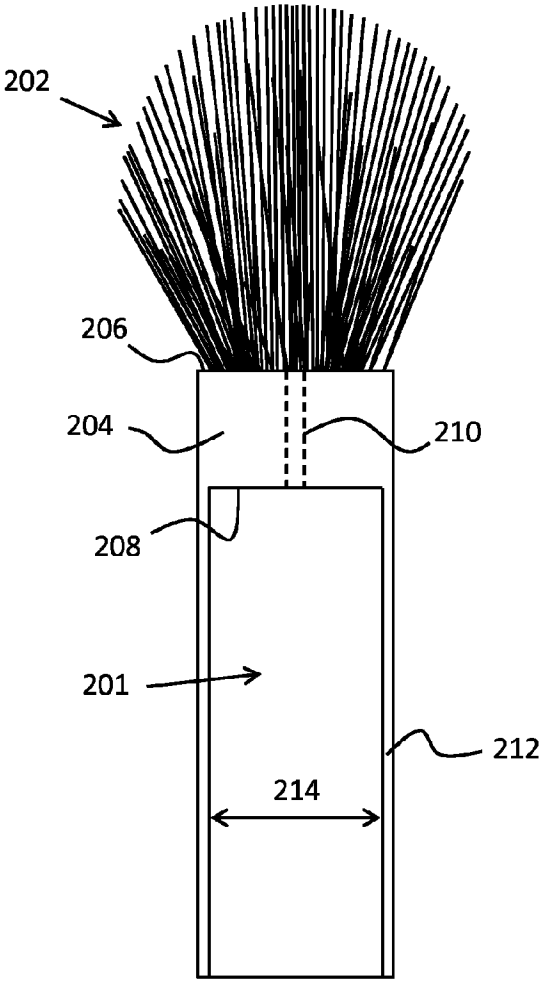
FIG. 2 is a cross-sectional elevational side view of a self-foaming shaving brush assembly in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient shaving brush assembly that includes an on-board shaving-cream container that dispenses shaving cream directly through the handle and into the brush's bristles. Embodiments of the invention provide an elongated handle body of a convenient size and shape for utilization in applying shaving cream to a user's face or other body parts. More specifically, the present invention, for the first time, provides a handle that conveniently houses a travel-size shaving cream container and, with a simple movement, transfers shaving cream from within the travel-size shaving cream container to the bristles of the inventive shaving brush. In addition, embodiments of the invention advantageously provide the ability to repeatedly apply shaving cream to the brush bristles with a simple movement of a single one of the users hands.

Figure 1:
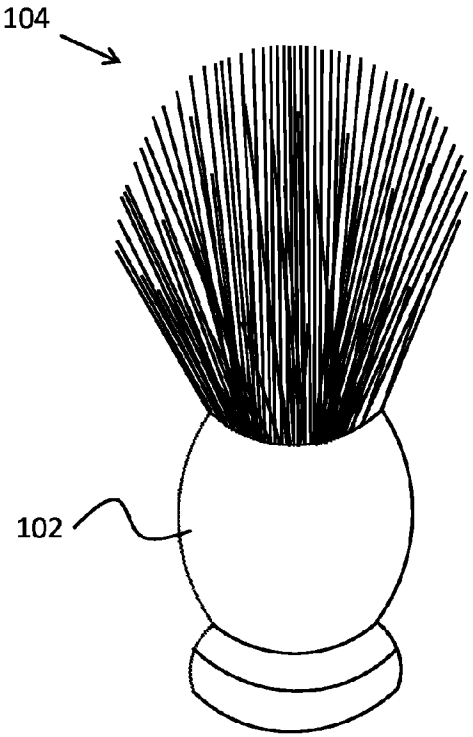
Prior art FIG. 1
FIG. 1 is a perspective view of a prior-art shaving brush assembly.

Referring now to FIG. 2, one embodiment of the present invention is shown in a cross-sectional elevational side view. FIG. 1 shows several advantageous features of the present invention, but, as will be described below, the invention can be provided in several shapes, sizes, combinations of features and components, and varying numbers and functions of the components. The first example of a shaving brush assembly, as shown in FIG. 2, includes a plurality of bristles 202 coupled to and supported by a base 204. The base 204 features a first side 206 and a second side 208, with the brush bristles 202 being attached to the first side 206 of the base 204.

The plurality of brush bristles 202 can be any material known in the art, ranging from synthetic materials, for example nylon, to top-of-the-line materials, such as, for example, badger hair. Some synthetic/natural fiber blends combine animal hair, for example, boar's hair, with synthetic bristles.

A passageway 210 is defined within and extends through the base 204 from the first side 206 to the second side 208 thereof. The passageway 210 is dimensioned to, as will be described below, allow an amount of shaving cream to pass from the second side 208 through the center of the base 204 and out of the first side 206 of the base 204, in one embodiment, the passageway 210 is formed substantially through the center of the base 204, but such a central location is not necessary.

As is further shown in FIG. 2, a sleeve 212 is coupled to the base 204. Advantageously, the sleeve 212 is formed with an inner cavity 201 that is suitable for receiving and housing a smaller-than-standard size shaving cream container, the sleeve 212 substantially enclosing the smaller-than-standard size shaving cream container. The term "smaller-than-standard-size," as used herein, indicates any shaving cream container that is smaller than the standard, commercially-available container, which is generally known by those of skill in the art as a "standard-sized" container. More specifically, one smaller-than-standard size shaving cream container is the well-known "travel-size" shaving cream container, which generally has an outer diameter of about 2.5" or less. Although the present invention solves a problem in the prior art of having a full-size shaving cream container attached to the handle, the invention is in no way restricted to use with any particular dimension of travel-size shaving cream container.

In addition to housing the smaller-than-standard size shaving cream container, the sleeve 212 advantageously servers a double purpose of also acting as a handle for the inventive shaving cream brush assembly. In accordance with one embodiment of the present invention, the length of the sleeve 212 is substantially the same as the standard length of a travel-size container of shaving cream 302, e.g., about 6".

Figure 3:
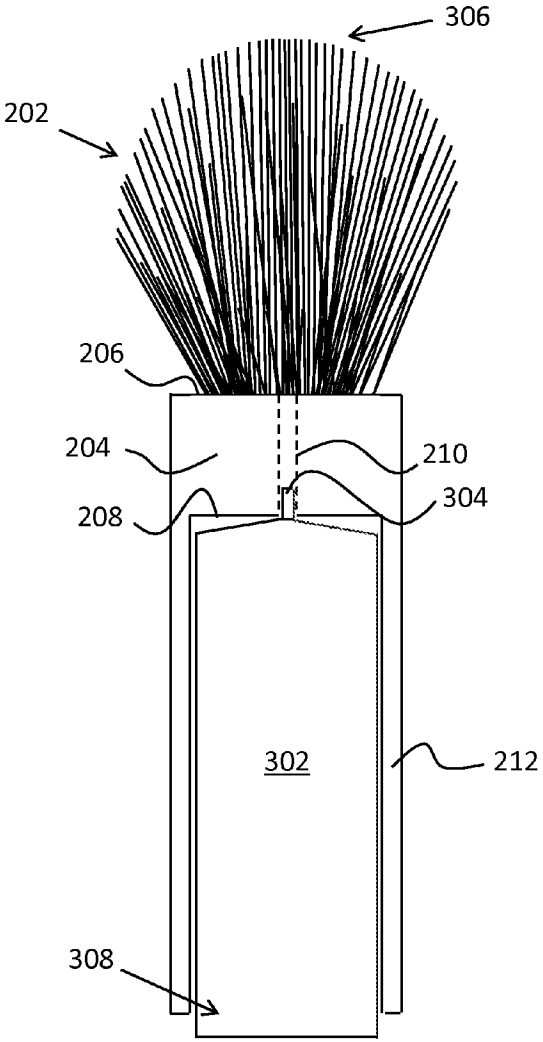
FIG. 3 is a cross-sectional elevational side view of the self-foaming shaving brush assembly of FIG. 2.

The sleeve 212 is sized to have an inner diameter 214 that is greater than a largest outer diameter of a smaller-than-standard size container of shaving cream, i.e., about 2.75" or more. Because the inner diameter 214 of the sleeve 212 is of such a dimension, as illustrated in FIG. 3, a smaller-than-standard size container of shaving cream 302 can easily be inserted within the interior of the sleeve 212.

It should be noted that the sleeve 212 is not necessarily round and the inner diameter 214 refers to a distance between opposing inner walls of the sleeve 212 measured at any point within the sleeve 212, such as is shown in FIG. 2. In one embodiment, the inner diameter 214 of the sleeve 212 is just slightly larger than the outer diameter of the smaller-than-standard size container of shaving cream 302 so that the sleeve 212 provides a frictional resistance against the smaller-than-standard size container of shaving cream 302. In this way, the sleeve 212 provides a holding force that retains the smaller-than-standard size container of shaving cream 302 within the sleeve 212.

Figure 4:
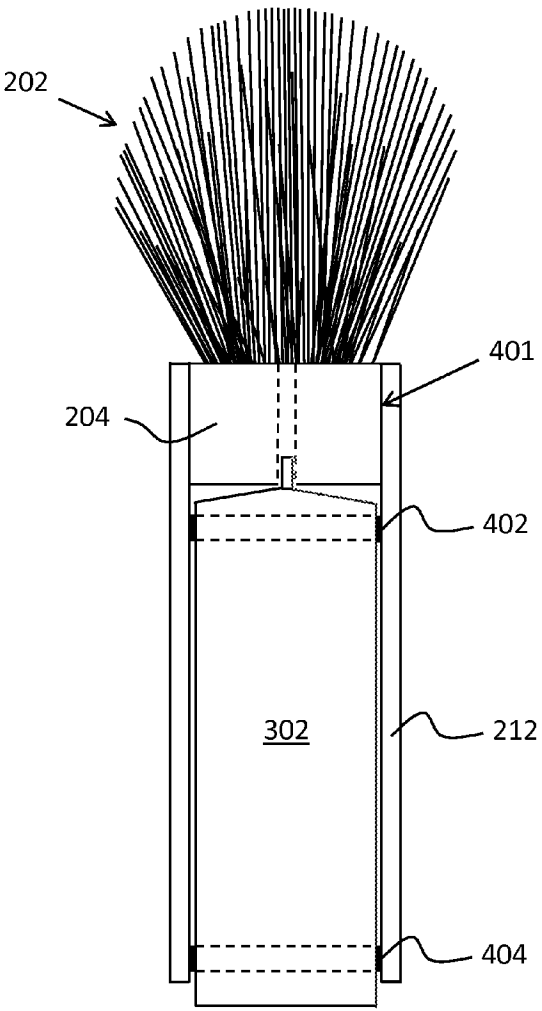
FIG. 4 is a cross-sectional elevational side view of a self-foaming shaving brush assembly with the base and sleeve being separate parts.

The invention can include O-rings, friction pads, or any other elements that help retain the smaller-than-standard size container of shaving cream 302 within the sleeve 212. FIG. 4 illustrates an exemplary placement of a pair of O-rings 402, 404 that seal and retain the container 302 within the sleeve 212. The O-rings 402, 404 are not restricted to the positions shown in the figure. In addition, the O-rings 402, 404 can be of any material, including rubber, foam, or paper, and do not have to be of the familiar O-ring, shape. Any element that assists sealing can be used for the O-rings 402, 404.

Insertion of the smaller-than-standard size container of shaving cream 302 within the sleeve 212 is accomplished by first removing the standard dispensing top from the smaller-than-standard size container of shaving cream 302. This top is well known in the art and is what a user typically presses on to cause shaving cream to be dispensed.

Once the top is removed, a dispensing nozzle 304, shown in FIG. 3, is exposed. After the smaller-than-standard size container of shaving cream 302 is inserted within the sleeve 212, nozzle end first, the smaller-than-standard size container of shaving cream 302 will slide distally until the nozzle 304 mates with and seats within the passageway 210, as is shown FIG. 3. In accordance with an embodiment of the present invention, the passageway 210 is provided with an inner diameter that is greater than a largest outer diameter of the dispensing nozzle 302 of the container of shaving cream 302. By causing the difference between the inner diameter of the passageway 210 and the a largest outer diameter of the dispensing nozzle 302 to be as small as possible, frictional forces will assist the dispensing nozzle 302 to stay within the passageway 210 once inserted.

As is known in the art, pressure exerted against dispensing nozzles of containers, such as dispensing nozzle 304 of the shaving cream container 302, opens a valve at the dispensing nozzle and allows the pressurized contents of the container to exit through the dispensing nozzle. In one embodiment of the present invention, the passageway 210 is dimensioned so as to provide frictional contact against the exterior of the nozzle 304 of the travel-size container of shaving cream 302. In this way, when a force is exerted against the container of shaving cream 302 in a distal direction, toward the brush bristles 202, the nozzle 304 remains stationary due to the friction. The movement of the container 302 relative to the nozzle 304 causes the non-illustrated valve at the nozzle 304 to open and eject shaving cream out of the nozzle 304 and into the passageway 210. Once through the passageway 210, the shaving cream is ejected at the base of the bristles 202 at the first side 206 of the base 204. Further shaving cream being forced through the passageway 210 will naturally force its way between and along the brush bristles until it surfaces at the distal end 306 of the bristles 202.

Advantageously, the presently-inventive shaving brush assembly 200 obviates the need for dipping the brush in an amount of shaving cream or using it to cause soft soap to develop into a foam. By simply exerting a small amount of pressure on the proximal end 308 of the smaller-than-standard size shaving cream container 302, shaving cream can continuously be made to appear at the distal end 306 of the brush bristles 202. In addition, the inventive assembly just described provides a. convenient device that fits easily within the hand of the average user and provides a comfortable, natural feel.

In the embodiment of the present invention shown in FIGS. 2 and 3, the sleeve 212 and the base 204 are illustrated as a single unitary piece. In other embodiments of the present invention, such as is shown in the cross-sectional elevational view of FIG. 4, the sleeve 212 and the base 204 are separate pieces, with the sleeve 212 press fitting onto or otherwise attaching to the base 204 to forma coupling connection 401, It should be noted that the sleeve 212 is not limited to any particular shape and can be a tubular or a non-tubular shape, such as square, hexagonal, ergonomic, and many others.

Figure 5:
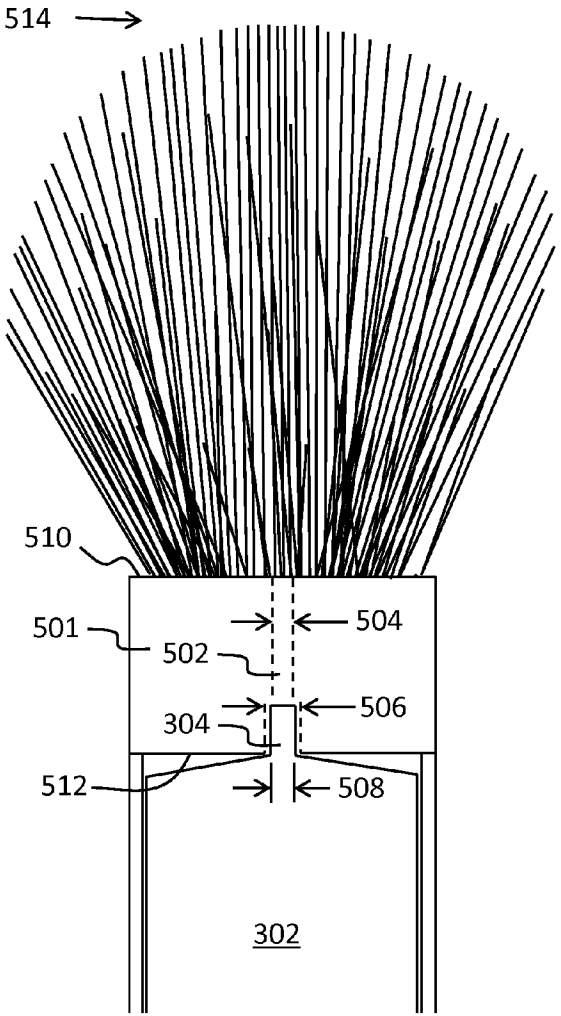
FIG. 5 is a cross-sectional partial elevational side view of a self-foaming shaving brush assembly with a stepped-diameter shaving-cream passageway in accordance with the present invention.

Referring now to the close-up partial elevational view of FIG. 5, it can be seen that, in accordance with one embodiment of the present invention, the passageway 502 defines a first inner diameter 504 that is less than a largest outer diameter 508 of the dispensing nozzle 304 of a container of shaving cream 302, The passageway 502 also defines a second inner diameter 506 that is greater than the outer diameter 508 of the dispensing nozzle 304 of the container of shaving cream 302. The first inner diameter 504 is closer to the first side 510 of the base 501 than is the second inner diameter 506. Likewise, the second inner diameter 506 is closer to the second side 512 of the base 510 than is the first inner diameter 504. The two adjacent differing diameters shown in FIG. 5 create a stair-step feature that provides a stopping point for the nozzle 304 at the discontinuity between the first diameter 504 and the second diameter 506. The discontinuity provides a usable surface upon which to apply force to the nozzle 304 when activation of the nozzle 304 is desired. Once the nozzle 304 is secured, further manipulation of the container 302 will cause the body of a container 302 to move distally, i.e., toward the distal end 514 of the assembly, relative to the nozzle 304, causing the valve at the nozzle 304 to activate and expel the contents of the container 302 into and through the passageway 502.

Figure 6:
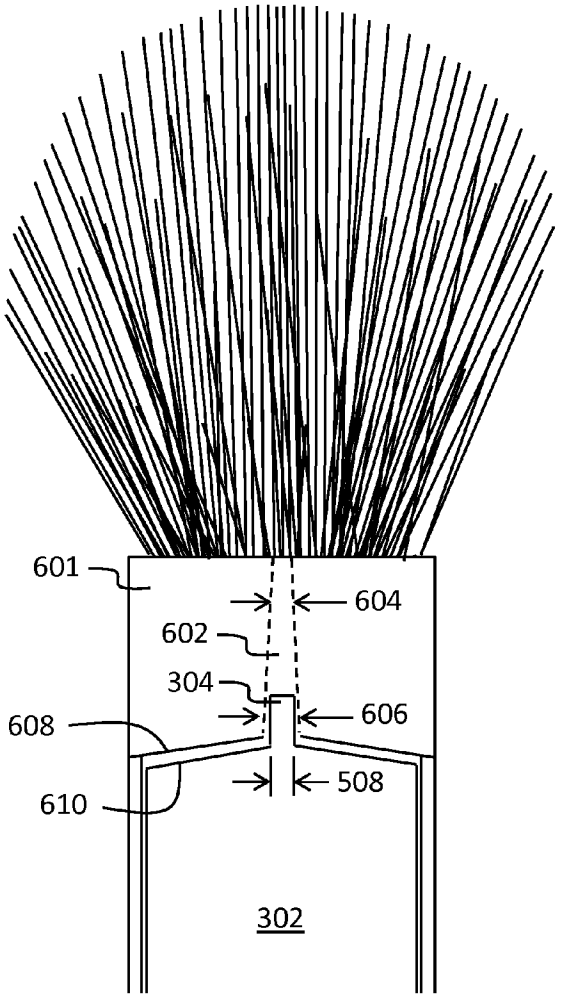
FIG. 6 is a cross-sectional partial elevational side view of a self-foaming shaving brush assembly with a tapered-diameter shaving-cream passageway in accordance with the present invention.

FIG. 6 shows a passageway 602 within a base 601 that shares geometric similarities to the passageway 502 of FIG. 5. That is, the passageway 602 defines a first inner diameter 604 that is less than a largest outer diameter 508 of the dispensing nozzle 304 of a container of shaving cream 302. The passageway 602 also defines a second inner diameter 606 that is greater than the outer diameter 508 of the dispensing nozzle 304 of the container of shaving cream 302. However, the passageway 602 of the base 601 does not feature a discontinuity as did the passageway 502 of the base 501. Instead, in the embodiment of FIG. 6, the passageway 602 gradually tapers between the first diameter 604 and the second diameter 606. The taper advantageously provides a series of locations along the tapered surface upon which to secure the nozzle 304 of the shaving cream container 302. Once the nozzle 304 is secured, further manipulation of the container 302 will cause the body of a container 302 to move relative to the nozzle 304, causing the valve at the nozzle 304 to activate and expel the contents of the container 302 into and through the passageway 602. In addition, FIG. 6 shows a lower inside surface 608 that is formed to mate with an upper surface 610 of the container 302 to provide improved mating.

In other embodiments, the passageway through the base can be defined at an angle to the first 510 and second 512 surfaces. The angular passageway ensures that the nozzle 304 of the shaving cream container 302 will be, at some point, presented with a surface upon which to halt further movement of the nozzle 304 in the distal direction. Once the nozzle 304 is secured, further manipulation of the container 302 will cause the body of a container 302 to move relative to the nozzle 304, causing the valve at the nozzle 304 to activate and expel the contents of the container 302 into and through the passageway.

Figure 7:
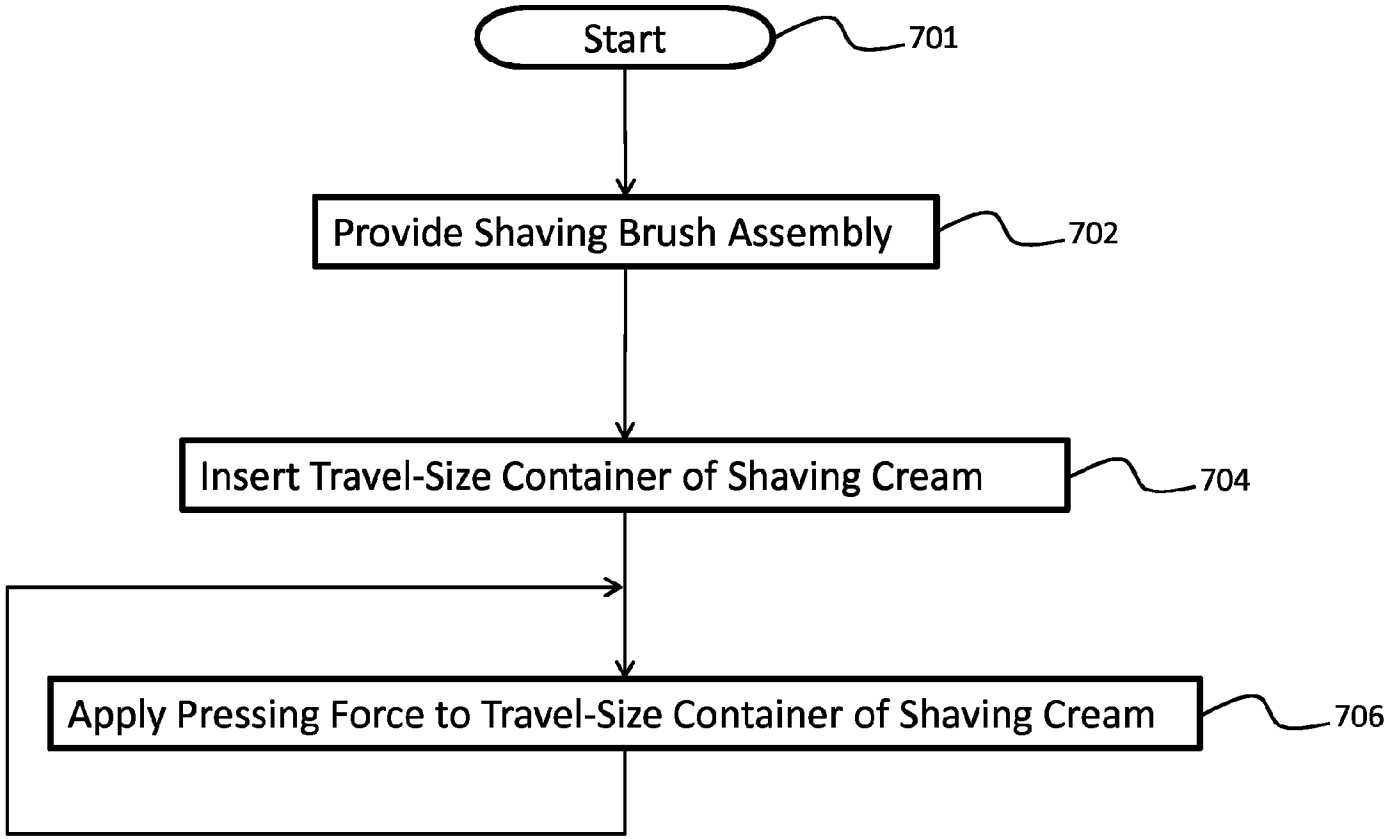

Referring now to FIG. 7, a process flow diagram is provided to illustrate a process for applying shaving cream to a shaving brush, such as the shaving brush assembly 200 shown in FIG. 2. The process begins at step 701 and moves directly to step 702 were a shaving brush assembly is provided, the assembly including any of the features previously described, for example, the shaving brush assembly 200 shown in FIG. 2. In step 704, a travel-size container of shaving cream is inserted within the sleeve 212 of the shaving brush assembly 200 so that a dispensing nozzle 304 of the travel-size container of shaving cream 302 is inserted at least partially within the passageway 210 through the base 204 of the shaving brush assembly 200. This step is illustrated by, for example, FIG. 3. In step 706, a pressing force is applied to the travel-size container of shaving cream 302 in a distal direction, i.e., toward the bristles 202, thus causing shaving cream to be emitted from the pressurized container 302, travel through the passageway 210 within the base 204, be pushed distally through the plurality of bristles 202, and be emitted from the most distal portion of the plurality of bristles 202. The process simply repeats step 706 as many times as desired.

Figure 8:
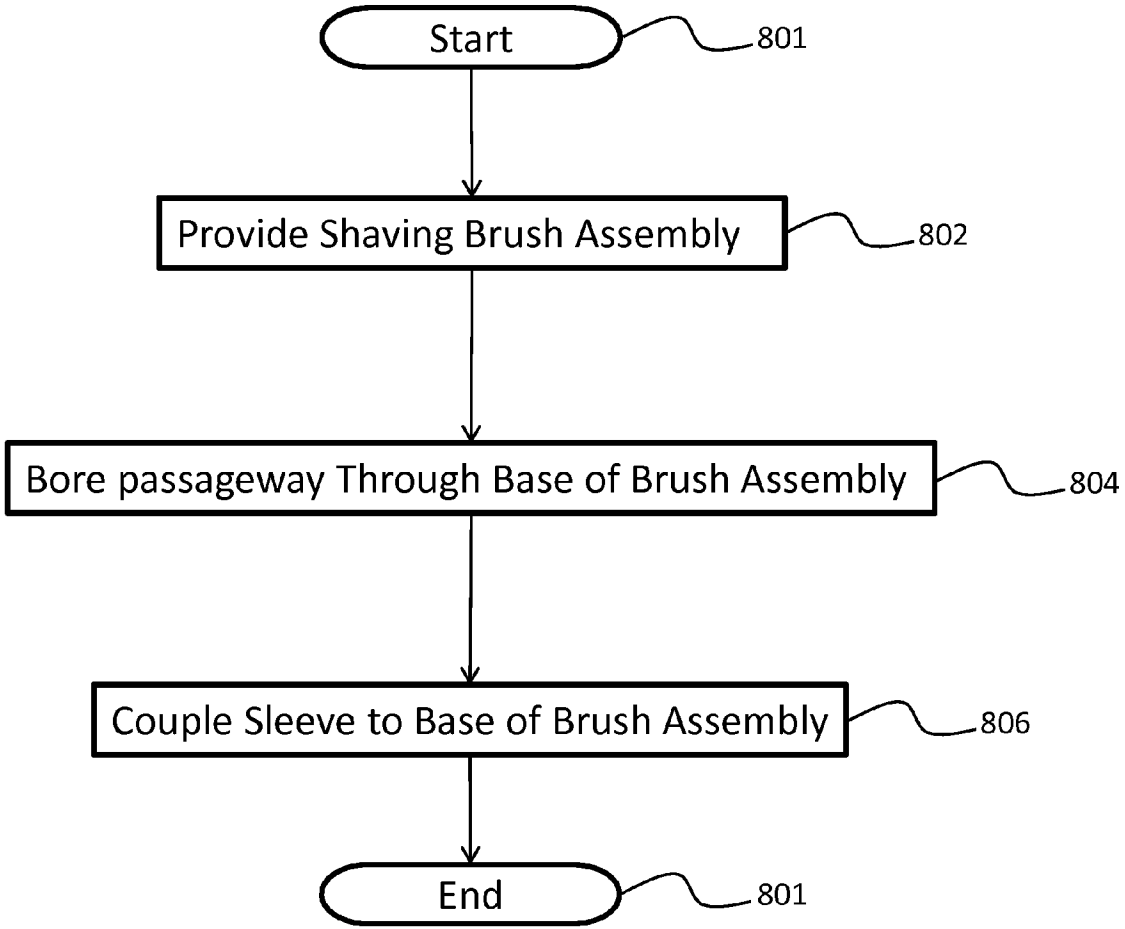
FIG. 8 is flow diagram illustrating a process of manufacturing a self-foaming shaving brush assembly in accordance with the present invention.

Referring now to FIG. 8, a process flow diagram is provided to illustrate a process for manufacturing a shaving brush assembly, such as brush 202, shown in FIG. 2. The process begins at step 801 and moves directly to step 802 were a shaving brush assembly is provided, such as shaving brush 100 shown in FIG. 1. In step 804, a passageway, such as passageway 210 shown in FIG. 2, is formed from a first side 206 of a base 204 of the brush assembly to a second. side 208 of the base 204. In step 806, a sleeve 212 is coupled to the base 204. The process ends at step 808.

A novel shaving brush assembly has been disclosed that overcomes the shortcomings of the prior art. Specifically, the inventive shaving brush assembly provides an automatic self-foaming shaving cream device that is an ideal size for holding while shaving. In addition, a novel method for using and manufacturing the inventive shaving brush assembly has also been disclosed.

What is claimed is:

1. A shaving brush assembly comprising:
- a plurality of bristles;
- a base:
  - having a first side coupled to and supporting the plurality of bristles;
  - a second side opposite the first side; and
  - defining a passageway from the first side to the second side, the passageway dimensioned to receive at least a portion of a nozzle of a shaving cream container; and
- a sleeve coupled to and extending from the second side of the base, the sleeve having:
  - an inner diameter less than an outer diameter of a standard-sized container of shaving cream and the inner diameter sized such that a travel-size container of shaving cream is frictionally retained within the sleeve,
  - an inner cavity adapted for receiving and housing the travel-size container and the inner cavity adapted for substantially enclosing the travel-size container; and
  - a length substantially the standard length of the travel-size container of shaving cream.

2. The shaving brush assembly according to claim 1, wherein the passageway comprises:
- an inner diameter that is greater than a largest outer diameter of a dispensing nozzle of a container of shaving cream.

3. The shaving brush assembly according to claim 1, wherein the passageway comprises:
- a first inner diameter that is less than a largest outer diameter of a dispensing nozzle of a container of shaving cream; and
- a second inner diameter that is greater than a largest outer diameter of a dispensing nozzle of a container of shaving cream.

4. The shaving brush assembly according to claim 3, wherein:
- the first inner diameter of the passageway is closer to the first side of the base than is the second inner diameter.

5. The shaving brush assembly according to claim 1, wherein:
- the passageway is located substantially in the center of the base.

6. The shaving brush assembly according to claim 1, wherein:

the sleeve is tubular in shape.

7. The shaving brush assembly according to claim 1, wherein:

the base and the sleeve are portions of a single physical element.

8. A method for applying shaving cream to a shaving brush, the method comprising:

providing a shaving brush assembly including:

a plurality of bristles;

a base:

having a first side coupled to and supporting the plurality of bristles;

a second side opposite the first side; and defining a passageway from the first side to the second side; and a sleeve coupled to the base, the sleeve having:

an inner diameter less than an outer diameter of a standard-sized container of shaving cream and the inner diameter sized such that a travel-size container of shaving cream is frictionally retained within the sleeve;

an inner cavity adapted for receiving and housing the travel-size container and the inner cavity adapted for substantially enclosing the travel-size container; and a length substantially the standard length of the travel-size container of shaving cream;

inserting the travel-size container of shaving cream within the sleeve so that a dispensing nozzle of the travel-size container of shaving cream is inserted at least partially within the passageway; and applying a pressing force to the travel-size container of shaving cream in a direction toward the bristles.

9. The method according to claim 8, wherein the passageway comprises:

an inner diameter that is greater than a largest outer diameter of a dispensing nozzle of a container of shaving cream.

10. The method according to claim 8, wherein the passageway comprises:

a first inner diameter that is less than a largest outer diameter of a dispensing nozzle of a container of shaving cream; and a second inner diameter that is greater than a largest outer diameter of a dispensing nozzle of a container of shaving cream.

11. The method according to claim 10, wherein:

the first inner diameter of the passageway is closer to the first side of the base than is the second inner diameter.

12. The method according to claim 8, wherein:

the passageway is located substantially in the center of the base.

13. The method according to claim 8, wherein:

the sleeve is tubular in shape.

14. The method according to claim 8, wherein:

the base and the sleeve are portions of a single physical element.

15. A method of manufacturing a shaving brush assembly, the method comprising:

providing a shaving brush assembly including:

a plurality of bristles; and a base:

having a first side coupled to and supporting the plurality of bristles; and a second side opposite the first side;

boring a passageway from the first side of the base to the second side of the base, the passageway dimensioned to receive at least a portion of a nozzle of a shaving cream container; and coupling a sleeve to the base, the sleeve extending from the second side of the base and the sleeve having:

an inner diameter less than an outer diameter of a standard-sized container of shaving cream and the inner diameter sized such that a travel-size container of shaving cream is frictionally retained within the sleeve;

an inner cavity adapted for receiving and housing the travel-size container and the inner cavity adapted for substantially enclosing the travel-size container; and a length substantially the standard length of the travel-size container of shaving cream.

* * * * *